US007010939B2

(12) United States Patent
Yoshikawa et al.

(10) Patent No.: US 7,010,939 B2
(45) Date of Patent: Mar. 14, 2006

(54) GLASS SUBSTRATE FOR DATA RECORDING MEDIUM AND MANUFACTURING METHOD THEREOF

(75) Inventors: Takamasa Yoshikawa, Osaka (JP); Koichi Suzuki, Osaka (JP)

(73) Assignee: Hoya Corporation, Tokyo (JP)

( * ) Notice: Subject to any disclaimer, the term of this patent is extended or adjusted under 35 U.S.C. 154(b) by 260 days.

(21) Appl. No.: 10/454,230

(22) Filed: Jun. 4, 2003

(65) Prior Publication Data

US 2003/0228461 A1 Dec. 11, 2003

(30) Foreign Application Priority Data

Jun. 5, 2002 (JP) ..... 2002-164149

(51) Int. Cl.
*C03C 21/00* (2006.01)
*C03C 15/00* (2006.01)

(52) U.S. Cl. ..... 65/30.14; 51/308; 65/31; 65/61; 216/52; 216/53; 451/37; 451/41

(58) Field of Classification Search ..... 61/308; 65/30.14, 31, 61; 216/52, 53; 451/37, 41
See application file for complete search history.

(56) References Cited

U.S. PATENT DOCUMENTS

| | | | | |
|---|---|---|---|---|
| 6,236,542 | B1 | 5/2001 | Hartog et al. | 360/135 |
| 6,277,465 | B1 | 8/2001 | Watanabe et al. | 428/141 |
| 6,322,425 | B1 | 11/2001 | Darcangelo et al. | 451/41 |
| 6,551,175 | B1 * | 4/2003 | Koichi et al. | 451/41 |
| 2003/0109202 | A1 * | 6/2003 | Matsuno et al. | 451/41 |
| 2003/0121285 | A1 * | 7/2003 | Kesuka et al. | 65/61 |

FOREIGN PATENT DOCUMENTS

| | | |
|---|---|---|
| EP | 1065251 | 1/2001 |
| JP | 7-240025 | 9/1995 |
| JP | 10-241144 | 9/1998 |
| JP | 2001-11433 | 1/2001 |
| JP | 2001-77065 | 3/2001 |
| JP | 2001-288455 | 10/2001 |

* cited by examiner

*Primary Examiner*—Sean Vincent
(74) *Attorney, Agent, or Firm*—Marsh Fischmann & Breyfogle LLP

(57) ABSTRACT

In a first polishing step, or in a first half of a super precision polishing, a surface of a glass substrate is polished with a first suspension. The first suspension contains particles and a dispersion agent in which the particles are dispersed. The main ingredient of the particles is silicon dioxide ($SiO_2$), and the average size ($D_{50}$) of the particles is equal to or less than 100 nm. The dispersion medium comprises an acid solution the pH of which is equal to or less than 4. In a second polishing step, or in a latter half of the super precision polishing, the surface of the glass substrate is continuously polished with a second suspension. The second suspension contains particles and a dispersion agent in which the particles are dispersed. The main ingredient of the particles is silicon dioxide ($SiO_2$), and the average size ($D_{50}$) of the particles is equal to or less than 100 nm. The dispersion medium comprises an alkaline solution the pH of which is equal to or more than 8.5.

12 Claims, 1 Drawing Sheet

GLASS SUBSTRATE FOR DATA RECORDING MEDIUM AND MANUFACTURING METHOD THEREOF

BACKGROUND OF THE INVENTION

The present invention relates to a glass substrate for a data recording medium of a data recording apparatus such as a hard disk. For example, the present invention relates to a glass substrate used in a magnetic disk, a magneto-optical disk, an optical disk. The present invention also relates to a method for manufacturing such a glass substrate.

Typically, a magnetic disk, which is a type of data recording media, is used, for example, in a hard disk drive. Such a magnetic disk is manufactured by forming magnetic layers and other layers on the surface of a glass substrate for data storing medium. The hard disk drive has a magnetic head (hereinafter referred to as a head) for reading data magnetically recorded on the magnetic disk. The head is moved while floating from the surface of the magnetic disk.

If the surface of the magnetic disk is uneven, the head collides with the uneven surface when being moved, which damages the head and the magnetic disk. Further, in recent years, there has been a demand for greater storage capacities of hard disks by increasing the recording density. To meet this demand, the distance between a magnetic disk and the head must be minimized. Thus, glass substrates for data recording media used in magnetic disks are manufactured by subjecting the surfaces of glass substrates to a precision polishing. Accordingly, the smoothness of the glass substrate surfaces are improved to obtain even surfaces.

In the above polishing, a suspension, or slurry in which particles are dispersed in water, is used as a polishing agent. The main ingredients of the particles are cerium oxide and silicon dioxide. This is because the sizes of the cerium oxide and silicon dioxide are small and thus the cerium oxide and silicon dioxide have superior polishing efficiency to increase the smoothness of polished surfaces. Due to the recent widespread use of information technology devices such as computers, a significant number of magnetic disks are demanded. Accordingly, the amount of production per unit time needs to be increased. The amount of production can be increased simply by increasing the size of a polishing apparatus of glass substrates or by increasing the sizes of the particles. However, in these cases, the quality and the yield are lowered. It is therefore required to increase the amount of production while maintaining the quality.

SUMMARY OF THE INVENTION

The present invention was made for solving the above problems in the prior art. Accordingly, it is an objective of the present invention to provide a glass substrate for data recording media and a method for manufacturing the glass substrate, which glass substrate and method maintain a high quality while increasing the amount of production.

To achieve the foregoing and other objectives and in accordance with the purpose of the present invention, a method for polishing a surface of a glass substrate is provided. The method includes a rough polishing step, a precision polishing step, and a super precision polishing step. The super precision polishing step comprises: a first polishing step for polishing the surface of the glass substrate with a first suspension, wherein the first suspension contains particles and a dispersion medium in which the particles are dispersed, wherein the main ingredient of the particles is silicon dioxide ($SiO_2$), and the average size ($D_{50}$) of the particles is equal to or less than 100 nm, and wherein the dispersion medium comprises an acid solution the pH of which is equal to or less than 4; and a second polishing step for continuously polishing the surface of the glass substrate with a second suspension, wherein the second suspension contains particles and a dispersion medium in which the particles are dispersed, wherein the main ingredient of the particles is silicon dioxide ($SiO_2$), and the average size ($D_{50}$) of the particles is equal to or less than 100 nm, and wherein the dispersion medium comprises an alkaline solution the pH of which is equal to or more than 8.5.

According to another aspect of the present invention, a glass substrate is provided. The roughness average (Ra) of a surface of the glass substrate is equal to or less than 0.4 nm. The maximum profile peak height (Rp) of the surface is equal to or less than 2 nm.

Other aspects and advantages of the invention will become apparent from the following description, taken in conjunction with the accompanying drawings, illustrating by way of example the principles of the invention.

BRIEF DESCRIPTION OF THE DRAWING

The invention, together with objects and advantages thereof, may best be understood by reference to the following description of the presently preferred embodiments together with the accompanying drawing in which.

DETAILED DESCRIPTION OF THE PREFERRED EMBODIMENTS

Figure 1:
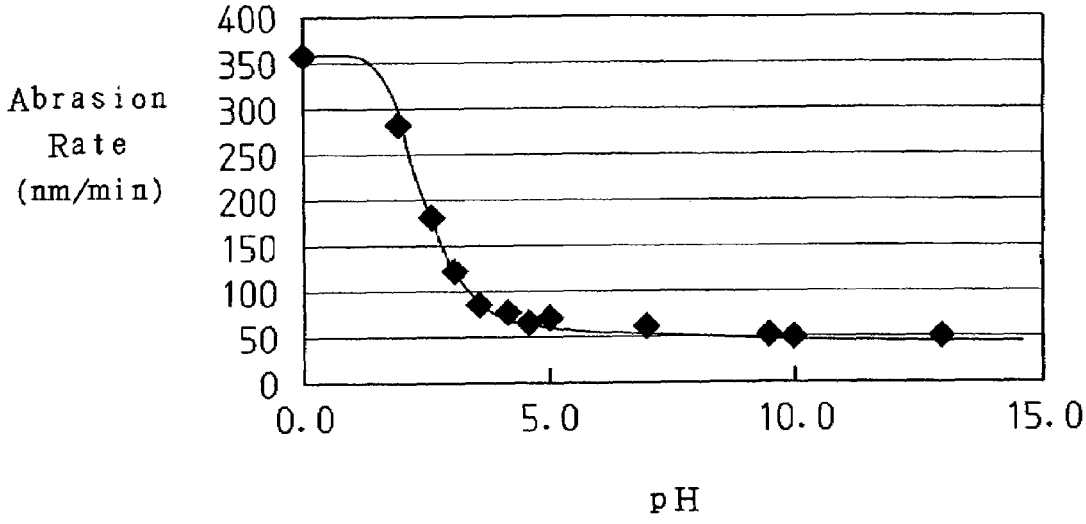
FIG. 1 is a graph showing the relationship between the pH and the abrasion rate of a polishing agent.

A preferred embodiment of the present invention will now be described with reference to the drawing.

A glass substrate for a data recording medium is shaped like a disk and has a circular hole in the center. The glass substrate is used as a substrate of an information recording medium such as a magnetic disk, a magneto-optical disk, and an optical disk. The glass substrate is made of, for example, soda lime glass, alminosilicate glass, borosilicate glass, and crystallized glass. These glasses are manufactured by a float process, a down draw process, a redraw process, or a press process. Layers including a magnetic film are laminated on the glass substrate for forming a date recording medium. The surface of the medium functions as a data recording portion. The data recording portion includes a landing zone and chamfers. A head for reading data recorded on the data recording medium contacts the landing zone. The chamfers are formed at the outer circumference and the inner circumference of the recording portion. The area of the data recording portion except for the landing zone and the chamfers is used for recording data on the data recording medium.

The recording density of the data recording medium is increased by reducing the distance between the surface of the data recording portion and the head. If the surface of the glass substrate is uneven, the data recording portion is also uneven. The uneven surface contacts or interferes with the head, which may prevent recorded data from being accurately read and damage the head and the data recording portion. Accordingly, the glass substrate is subjected to a precision polishing so that the surface is even.

The unevenness of the glass substrate surface is represented by roughness average (Ra) and maximum height of profile (Ry), which are defined in JIS B0601-1994. When measuring the roughness average (Ra), a roughness curve is obtained. The maximum height of profile (Ry) is the sum of the maximum profile peak height (Rp) and the maximum profile valley depth (Rv), which are obtained with reference to the average line of the roughness curve as a reference. The head is arranged to slightly float from the data recording portion when being moved. Therefore, if the surface is uneven, the head skips depressions even if the size of the depression is large. However, when moving over relatively large projections, the head cannot skip the projections. Accordingly, the inventors of the present invention came to a conclusion that projections must be reduced to eliminate the above drawbacks by setting the roughness average (Ra) and the maximum profile peak height (Rp) in appropriate ranges.

The roughness average Ra of the glass substrate of this embodiment is equal to or less than 0.4 nm. If the roughness average Ra is greater than 0.4 nm, a great number of projections and depressions are formed and the surface is roughened. This results in unstable movement of the head and causes the above mentioned drawbacks. If the roughness average Ra is equal to or less than 0.4 nm, the quality of the glass substrate is satisfactory. However, to further increase the recording density, the roughness average Ra is preferably smaller. The roughness average Ra is therefore preferably less than 0.2 nm.

The maximum profile peak height Rp of the glass substrate of this embodiment is equal to or less than 2 nm. If the maximum profile peak height Rp is greater than 2 nm, at least one large projection exists on the surface. In this case, the head can collide with the projection, and the above mentioned drawbacks are caused. To further increase the recording density, the maximum profile peak height Rp must be reduced. Thus, the maximum profile peak height Rp is preferably equal to or less than 1.5 nm. Since a smaller Rp is preferable, no lower limit of Rp is determined.

If the roughness average Ra is less than 0.2 nm, the ratio of Rp to the roughness average Ra (Rp/Ra) is preferably less than 10. If Rp/Ra is greater than 10, the average roughness Ra is improved. However, the maximum profile peak height Rp is not improved and large projections exist on the surface of the glass substrate. To avoid collisions between the projections and the head, the distance between the glass substrate surface and the head cannot be reduced. This hinders the recording density from being increased. The maximum height of the profile Ry is preferably less than 3 nm. If the maximum height of the profile Ry is equal to or greater than 3 nm, at least a part of the surface can be significantly rough and hinders the recording density from increased. The lower limit of the maximum height of the profile Ry is not specified. It is generally difficult to set the maximum height of the profile Ry to a value less than 2 nm. An attempt to decrease Ry to a value less than 2 nm can lower the manufacturing efficiency.

If the roughness average Ra, the maximum profile peak height Rp, and the maximum height of the profile Ry are in the above mentioned ranges, the floating height of the head from the surface of the glass substrate is equal to or less than 4.5 nm. The floating height of the head is hereinafter referred to HTO. If HTO is higher than 4.5 nm, it is difficult to increase the recording density. The lower limit of HTO is not specified. Since a lower value of HTO is preferably, HTO is set equal to or greater than 0 nm.

A method for manufacturing the glass substrate for the data recording medium will now be described.

The glass substrate for the data recording medium of this embodiment is manufactured by cutting a circular glass substrate from a glass sheet such that the glass substrate has a predetermined outer and inner diameters, and then applying three stages of polishing to the surface of the glass substrate. The polishing may be carried out either in a sheet mode, in which glass substrates are polished one by one, or in a batch mode, in which a number of glass substrates are polished simultaneously.

In the first polishing stage, the surface of the glass substrate is roughly polished. Through the rough polishing process, the thickness of the glass substrate is adjusted to a predetermined value. The rough polishing process also eliminates significant defects such as great swells, chippings, and cracks, thereby improving the surface conditions to a certain level.

In the rough polishing process, a hard polisher is used for roughly polishing the surface of the glass substrate. The hard polisher is a foam resin that has a hardness of 65 to 85 (TYPE A or Shore A) as classified in Japanese Industrial Standard (JIS) K6253-1997, 60 to 65% of compression modulus. The compressibility of the hard polisher is set to 2 to 4% when used. If the hardness is less than 65, the compression modulus is greater than 65%, or the compressibility is greater than 4%, the hard polisher is deformed in polishing and form swells on the glass substrate surface. If the hardness (TYPE A) is greater than 85, the compression modulus is less than 60%, or the compressibility is less than 2%, the hard polisher wears the glass substrate surface and roughens the surface.

Also, a polishing agent used in the rough polishing process is a slurry formed by dispersing abrasive material having an average size of approximately 1.2 $\mu$m in water as a solvent. The abrasive material may be, for example, alumina abrasive, rare earth oxides such as cerium oxide and lanthanum oxide, zirconium oxide, manganese dioxide, aluminum oxide, or colloidal silica. Rare earth oxides have the best polishing efficiency among these materials and therefore are preferred. Particularly, cerium oxide is most favorable.

In the rough polishing process of this embodiment, the amount of abrasion is preferably from 15 to 40 $\mu$m. If the amount of abrasion is less than 15 $\mu$m, the surface condition can be unsatisfactory. If the amount of abrasion is greater than 40 $\mu$m, the surface condition is not improved compared to a case where the amount of abrasion is 40 $\mu$m, and the polishing time is undesirably extended. This lowers the production efficiency.

In the second polishing stage, the surface of the glass substrate is subjected to precision polishing process. The precision polishing process improves the surface condition by removing swells and defects that have not been removed by the rough polishing process, polishing stress remaining on the surface of the glass substrate after the rough polishing process, and polishing scratches formed in the rough polishing process.

In the precision polishing process, a soft polisher is used for polishing the surface of the glass substrate. The soft polisher is a suede pad that has a hardness of 58 to 78 (Asker C) as classified in SRIS-0101 (SRIS: Society of Rubber Industry Japan Standards), 58 to 78% of compression modulus. The compressibility of the soft polisher is set to 1 to 5% when used. If the hardness (Asker C) is less than 58, the compression modulus is greater than 78%, or the compressibility is greater than 5%, the soft polisher is deformed in polishing and form minute swells on the glass substrate surface. If the hardness is greater than 78, the compression modulus is less than 58%, or the compressibility is less than 1%, the soft polisher wears the glass substrate surface and roughens the surface.

Also, a polishing agent used in the precision polishing is a slurry formed by dispersing abrasive material having an average size of approximately 0.8 μm in water. The abrasive material may be, for example, rare earth oxides such as cerium oxide and lanthanum oxide, zirconium oxide, manganese dioxide, aluminum oxide, or colloidal silica. Rare earth oxides have the best polishing efficiency among these materials and therefore are preferred. Particularly, cerium oxide is most favorable.

In the precision polishing process of this embodiment, the amount of abrasion is preferably from 2 to 10 μm. If the amount of abrasion is less than 2 μm, swells, minute swells, polishing stress, and polishing scratches are not sufficiently removed, and the surface condition is not satisfactory. If the amount of abrasion is greater than 10 μm, the surface condition is not improved compared to a case where the amount of abrasion is 10 μm, and the polishing time is undesirably extended. This lowers the production efficiency.

After the second stage, the roughness average (Ra) of the glass substrate is preferably 0.3 to 1.0 nm, and the maximum profile peak height Rp is preferably 3 to 7 nm. If the roughness average Ra is greater than 1.0 nm and the maximum profile peak height Rp is greater than 7 nm after the second stage, the quality of the surface condition cannot be improved in subsequent stage, or the time required for the subsequent stages are extended. If the roughness average Ra is less than 0.3 nm and the maximum profile peak height Rp is less than 3 nm after the second stage, the time required for the polishing process in the first and second stages, which lowers the production efficiency.

After subjected to the precision polishing process, the glass substrate is preferably chemically strengthened through a chemical strengthening process so that the impact resistance, the vibration resistance, and the heat resistance are improved to levels required for the data recording medium.

The chemical strengthening process refers to a process in which monovalent metal ion, such as lithium ion and sodium ion, included in the composition of the glass substrate is replaced with monovalent metal ion having greater ion radius such as sodium ion and potassium ion. Thereafter, the surface of the glass substrate is chemically strengthened by applying compression stress to the surface. The chemical strengthening process is performed by immersing the glass substrate in a chemical strengthening liquid, in which a chemically strengthening salt is dissolved by heating, for a predetermined period. The chemical strengthening salt is, for example, one of or mixture of two of potassium nitrate, sodium nitrate and silver nitrate.

The temperature of the chemical strengthening liquid is lower than the strain point of the material used for the glass substrate preferably by 50 to 150° C. More preferably, the temperature of the chemical strengthening liquid is 350 to 400° C. If the temperature of the liquid is less than a temperature that is lower than the strain point of the material of the glass substrate by approximately 150° C., the glass substrate is not sufficiently chemically strengthened. If the temperature of the liquid surpasses a temperature that is lower than the strain point of the material of the glass substrate by 50° C., the chemical strengthening process can create distortion in the glass substrate.

After the chemical strengthening process, the surface of the glass substrate is subjected to a polishing process of the third stage, or a super precision polishing process. The super precision polishing process eliminates roughness created during the chemical strengthening process, particularly minute swells, scratches and defects created in the previous stages. Specifically, the maximum profile peak height Rp is decreased so that the surface of the glass substrate is super smooth. That is, a high quality surface condition is obtained.

In the super precision polishing process, a soft polisher is used for polishing the surface of the glass substrate. The soft polisher is a suede pad that has a hardness of 58 to 78 (Asker C), 58 to 85% of compression modulus. The compressibility of the soft polisher is set to 1 to 5% when used. If the hardness is less than 58, the compression modulus is greater than 78%, or the compressibility is greater than 5%, the soft polisher is deformed in polishing and forms minute swells. If the hardness is greater than 78, the compression modulus is less than 58%, or the compressibility is less than 1%, the soft polisher wears the glass substrate surface and roughens the surface.

The polishing agent used in the super precision polishing process is a suspension formed by dispersing particles having an average size ($D_{50}$) equal to or less than 100 nm a dispersion medium. The main ingredient of the agent is silicon dioxide ($SiO_2$). If the average size of the particles is greater than 100 nm, the abrasive material forms scratches on the surface. The scratches causes defects and roughens the surface. The concentration of the particles in the polishing agent is preferably 5 to 40% by weight. If the concentration of the particles is less then 5% by weight, the polishing efficiency is lowered and the surface may be insufficiently super smooth. If the concentration exceeds 40% by weight, the particles can form scratches on the surface, which degrades the quality.

The polishing agent, which has particles of silicon dioxide as a main ingredient, is, for example, fumed silica or colloidal silica. Fumed silica is manufactured by forming particles through baking. Colloidal silica is manufactured by growing larger particles from smaller particles. Colloidal silica may be a water glass type or a sol-gel type. The particles in a water glass type colloidal silica are grown for a long time through Oswald ripening. The particles of a sol-gel type colloidal silica are grown for a short time. A sol-gel type colloidal silica is favorable because it is easily dissolved in an alkaline aqueous solution and is easily removed in a cleaning process after the super precision polishing process.

The super precision polishing process is divided into a primary polishing step and a secondary polishing step. In these steps, polishing agents having different solvents are used.

In the primary polishing step, the entire surface of the glass substrate is polished while being dissolved using acid solution as a dispersion medium. Accordingly, the abrasion rate representing an abrasion amount per unit time is improved, and, particularly, the roughness average Ra is reduced. The acid solution is, for example, sulfuric acid, sulfamic acid, hydrochloric acid, nitric acid, phosphoric acid, or hydrofluoric acid. Particularly, sulfuric acid is favorable since it is easy to come by and has a relatively small influence to users and the environment. Since an acid solution is used as the dispersion medium in the primary polishing step, the pH of the medium is equal to or less than 4. If the polishing agent having a pH over 4 is used, the abrasion rate is not improved.

In the primary polishing step, the amount of abrasion is preferably from 0.1 μm. If the abrasion amount is less than 0.1 μm, the roughness average Ra is not decreased, and the surface can be insufficiently super smooth. The upper limit of the abrasion amount in the primary polishing step is not specified. However, if the surface is polished to a level that exceeds a certain level, the quality of the surface cannot be further improved by removing minute swells, scratches, and defects, and the time required for polishing is unnecessarily extended. This lowers the production efficiency. Thus, to improve the quality of the glass surface while maintaining or improving the production efficiency, the upper limit of the abrasion amount is 2 μm.

In the primary polishing step, the abrasion rate is preferably 30 to 600 nm/min, and more preferably 30 to 500 nm/min. If the abrasion rate is less than 30 nm/min, the time required for the primary polishing step is extended and the production efficiency is lowered. To improve the production efficiency, a higher abrasion rate is preferable. However, if the abrasion rate is too high, the surface is roughened and the roughness average of the surface of the glass substrate is increased. This lowers the yield. Therefore, to maintain the quality of the surface of the glass substrate while improving the production efficiency, the upper limit of the abrasion rate is preferably 600 nm/min. To further improve the quality of the surface, the upper limit of the abrasion rate is preferably 500 nm/min.

The secondary polishing step is performed for lowering the maximum profile peak height Rp by using alkaline solution is used as the dispersion medium. That is, if the polishing agent contains particles the main ingredient of which is silicon dioxide is used, the particles coagulate on and are adhered to the surface of the glass substrate, which can form great projections. Since acid solution is used as the dispersion medium in the primary polishing step, electrostatic repulsion between the glass substrate and the particles is decreased, coagulation of particles are predicted to form large projections. Using alkaline solution as the solvent of the polishing agent increases the electrostatic repulsion between the glass substrate and particles. Thus, projections that are predicted to be formed by coagulation of particles in the primary polishing step are ground while preventing particles from coagulating in the secondary polishing step. The maximum profile peak height Rp is lowered.

The alkaline solution may be potassium hydroxide, sodium hydroxide, ammonia, tetramethyl hydroxide. Particularly, potassium hydroxide is favorable since it is easy to come by and has a relatively small influence to users and the environment. The pH of the polishing agent of the secondary polishing step is equal to or greater than 8.5. If the pH of the polishing agent is less than 8.5, Rp cannot be lowered, and the yield of the glass substrate is lowered.

The abrasion amount of the secondary polishing step is preferably equal to or more than 0.01 μm, more preferably from 0.01 to 0.07 μm, and most preferably from 0.01 to 0.05 μm. If the abrasion amount is less than 0.01 μm, the surface of the glass substrate is not sufficiently polished, and Rp can be insufficiently lowered. To improve the quality of the surface of the substrate, the abrasion amount is preferably great since projections and depressions are removed. However, if the abrasion amount increased to exceed a certain level, the quality of the surface cannot be further improved, and the time required for polishing is unnecessarily extended. This lowers the production efficiency. Therefore, to improve the quality of the surface of the glass substrate and to maintain the production efficiency, the upper limit of the abrasion amount is preferably 0.07 μm. To further improve the production efficiency, the upper limit of the abrasion amount is preferably 0.05 μm.

In the secondary polishing step, the abrasion rate is preferably 10 to 500 nm/min, and more preferably 10 to 200 nm/min. If the abrasion rate is less than 10 nm/min, the time required for the secondary polishing step is extended and the production efficiency is lowered. As described in the section of the primary polishing step, a higher abrasion rate improves the production efficiency and is therefore favorable. However, an excessively high abrasion rate roughens the surface and can lower the yield. Therefore, to maintain the quality of the surface of the glass substrate while improving the production efficiency, the upper limit of the abrasion rate is preferably 500 nm/min. To further improve the quality of the surface, the upper limit of the abrasion rate is preferably 200 nm/min.

In the super precision polishing process, a rinsing step may be performed between the primary polishing step and the secondary polishing step. The rinsing step is performed by scrubbing the surface with a polisher while supplying water, pure water, or hot water to the surface instead of polishing agent. The rinsing step is performed for removing residues of polishing agent from the surface of the glass substrate and the polisher.

After being subjected to the three-stage polishing, the glass substrate is subjected to a cleaning process so that foreign substances such as polishing powder, polishing agent, and dust are removed. A cleaning liquid for cleaning the glass substrate may be organic solution, acid solution, alkaline solution, cold water, and hot water. Organic solution may be isopropyl alcohol (IPA), methanol, ethanol, or butanol. The acid solution is, for example, hydrofluoric acid, sulfuric acid, sulfamic acid, hydrochloric acid, nitric acid, phosphoric acid. The alkaline solution may be potassium hydroxide, sodium hydroxide, ammonia, tetramethyl hydroxide. A builder, which is generally used in this type of cleaning, may be added to the cleaning fluid. Added builder may be cationic, anionic, or nonionic surface-active agent or chelating agent.

If colloidal silica is used in the super precision polishing process, the glass substrate is preferably cleaned with at least one of cold water, hot water and alkaline solution having a pH of 12 or less, since these cleaning fluid effectively remove the colloidal silica without coagulating colloidal silica. To improve the degree of cleaning, the glass substrate may be cleaned with strong alkaline solution having a pH over 12, acid solution, or organic solution.

The advantages of the above embodiment are as follows.

In this embodiment, the glass substrate for a data recording medium is subjected to the first and second polishing processes. Then, the glass substrate is subjected to the third polishing process. In the third polishing process, the glass substrate is polished in the primary polishing step and the secondary polishing step. In the primary polishing process, the glass substrate is polished with an acid polishing agent having a pH of 4 or less. In the secondary polishing step, the glass substrate is polished with an alkaline polishing agent having a pH of 8.5 or more. Using the acid polishing agent in the primary polishing step increases the abrasion rate and lowers the roughness average. Using the alkaline polishing agent in the secondary polishing step removes projections formed in the primary polishing step, thereby lowering the maximum profile peak height Rp. Therefore, the roughness average Ra and Rp of the glass substrate are lowered, and the quality of the substrate is increased. Also, although there are three stages of polishing, the glass substrate is manufactured in a short time. Thus, while maintaining a high quality of the glass substrate, the production efficiency is improved.

Also, the glass substrate for a data recording medium manufacture according to the embodiment has a roughness average of 0.4 nm or less, and the maximum profile peak height is 2 nm or less. Therefore, the surface of the glass substrate is super smooth. In other words, the glass substrate suitable for increased recording density is reliably obtained at a high yield.

EXAMPLES

Examples of the above embodiment and a comparison example will now be described.

Examination of Correlation Between the pH of Polishing Agent and Abrasion Rate

While changing the pH of a polishing agent containing colloidal silica as particles, the abrasion rate of the agent to the glass substrate was measured. As the colloidal silica, COMPOL-EM ($D_{50}$=40 nm) manufactured by Fujimi Incorporated was used. The glass substrate was one that was made of aluminosilicate glass. The diameter of the substrate was 2. 5 inches, and the thickness was 0.635 mm. The main compositions of the aluminosilicate glass were 65 mol % of $SiO_2$, 16 mol % of $Al_2O_3$, 4.0 mol % of $Li_2O$, 9.0 mol % of $Na_2$, 2.0 mol % of MgO, and 4.0 mol % of CaO. FIG. 1 shows the relationship between the pH and the abrasion rate of a polishing agent.

As obvious from FIG. 1, the abrasion rate was increased as the pH is lowered. Particularly, when the pH of the polishing agent was equal to or less than 4, the abrasion rate was suddenly increased. When the pH of the polishing agent was equal to or more then 8.5, the abrasion rate scarcely changed.

Example 1

In the example 1, a substrate made of aluminosilicate glass having a diameter of 2.5 inches was used. The glass substrate was subjected to a rough polishing process with a grinder using a polishing agent that had particles. The main ingredient of the particles was cerium oxide (Mirek 801 of Mitsui Mining and Smelting Co., Ltd). After the rough polishing, the glass substrate was subjected to a precision polishing process with a grinder using a polishing agent having particles. The main ingredient of the particles was cerium oxide (Mirek SO-s of Mitsui Mining and Smelting Co., Ltd). The rough polishing process and the precision polishing process were performed with double-side grinders. After the precision polishing process, the roughness average Ra of the glass substrate was 0.5 nm, and the maximum profile peak height Rp was 5 nm. After the precision polishing process and before a super precision polishing process, the thickness of the glass substrate was 0.635 mm.

After the precision polishing process, the glass substrate was subjected to the primary polishing step of the super precision polishing process with a double side grounder using a polishing agent having a pH of 3. The soft polisher was a suede pad that has a hardness of 77 (Asker C), 80% of compression modulus. The compressibility of the soft polisher was set to 2%. The polishing agent used in the super precision polishing process was a suspension formed by dispersing particles, the main ingredient of which was colloidal silica (COMPOL-EM manufactured by Fujimi Incorporated, $D_{50}$=40 nm), in a sulfuric solution as a dispersion medium. The weighting of the soft polisher applied to the glass substrate in the primary polishing step was 30 g/cm$^2$, and the polishing time was five minutes.

After the primary polishing step, the glass substrate was subjected to the secondary polishing step of the super precision polishing process with the same double side grounder and the same soft polisher using a polishing agent having a pH of 9.5. The polishing agent potassium hydroxide solution the secondary polishing step was a suspension formed by dispersing particles, the main ingredient of which was the same colloidal silica used in the primary polishing step, in potassium hydroxide (KOH). The weighting of the soft polisher applied to the glass substrate in the secondary polishing step was 30 g/cm$^2$, and the polishing time was one minute. The glass substrate, which was a test sample of the example 1, was obtained in this manner.

The abrasion amount in the primary polishing step was 0.3 $\mu$m, and the abrasion amount in the secondary polishing step was 0.03 $\mu$m. The surface of the glass substrate of the example 1 was observed with an atomic force microscope (AFM). Four fields of view, each of which was a square having sides of 10 $\mu$m, was observed. As a result, the roughness average Ra measured in each field of view was approximately 0.36 nm, and the maximum profile peak height Rp was approximately 1.5 nm. The results are shown in the following table.

| | | | Example 1 | Example 2 | Comparison Example 1 | Comparison Example 2 |
|---|---|---|---|---|---|---|
| Rough Polishing Agent | | | Cerium Oxide | Cerium Oxide | Cerium Oxide | Cerium Oxide |
| Precision Polishing Agent | | | Cerium Oxide | Cerium Oxide | Cerium Oxide | Cerium Oxide |
| Ra after Precision Polishing | | | 0.5 nm | 0.5 nm | 0.5 nm | 0.5 nm |
| Rp after Precision Polishing | | | 5 nm | 5 nm | 5 nm | 5 nm |
| Super Precision Polishing | Primary Polishing Step | $D_{50}$ of Colloidal Silica | 40 nm | 20 nm | 40 nm | 20 nm |
| | | pH of Sulfuric Acid Suspension | 3 | 3 | 3 | 3 |
| | | Abrasion Amount | 0.3 $\mu$m | 0.2 $\mu$m | 0.3 $\mu$m | 0.2 $\mu$m |
| | Secondary Polishing | $D_{50}$ of Colloidal | 40 nm | 20 nm | — | — |

-continued

| | | Example 1 | Example 2 | Comparison Example 1 | Comparison Example 2 |
|---|---|---|---|---|---|
| Step | Silica | | | | |
| | pH of suspension | 9.5 | 9.5 | — | — |
| | Abrasion Amount | 0.03 μm | 0.02 μm | — | — |
| Ra after Super Precision Polishing | | Approx. 0.36 nm | Approx. 0.23 nm | Approx. 0.42 nm | Min. 0.2 nm Max. 0.25 nm |
| Rp after Super Precision Polishing | | Approx. 1.5 nm | Approx. 1 nm | Approx. 2 nm | Min. 1 nm Max. 5 nm |

Example 2

A glass substrate made of aluminosilicate glass and having a diameter of 2.5 inches was prepared. The glass substrate was subjected to the rough polishing process and the precision polishing process as in the example 1. Thereafter, as in the example 1, the glass substrate was subjected to the primary and secondary polishing steps of the super precision polishing process. In the super precision polishing process, a polishing agent having colloidal silica (COMPOL-20 manufactured by Fujimi Incorporated, $D_{50}$=20 nm as particles was used. In the primary polishing step, a polishing agent having a sulfuric acid solution as a dispersion medium was used. The pH of the polishing agent was set to 3. In the secondary polishing step, a polishing agent having KOH as a dispersion medium was used. The pH of the polishing agent was set to 9.5. The abrasion amount in the primary polishing step was 0.2 μm, and the abrasion amount in the secondary polishing step was 0.02 μm. As in the example 1, the surface of the glass substrate of the example 2 was observed with an AFM. The roughness average Ra measured in each field of view was approximately 0.23 nm, and the maximum profile peak height Rp was approximately 1 nm.

Comparison Example 1

A glass substrate made of aluminosilicate glass and having a diameter of 2.5 inches was prepared. The glass substrate was subjected to the rough polishing process and the precision polishing process as in the example 1. Thereafter, as in the example 1, the glass substrate was subjected to the super precision polishing process to obtain a test sample of the example 1. The polishing agent used in this super precision polishing process was formed by dispersing colloidal silica ($D_{50}$=40 nm), which is the same as that in the example 1, in sulfuric acid solution. The pH of the agent was set to 3. The glass substrate, which was a test sample of the comparison example 1, was obtained in this manner. The weighting of the soft polisher applied to the glass substrate in the super precision polishing process was 30 g/cm$^2$, and the polishing time was five minutes. The abrasion amount was 0.3 μm. As in the example 1, the surface of the glass substrate of the comparison example 1 was observed with an AFM. The roughness average Ra measured in each field of view was approximately 0.42 nm, and the maximum profile peak height Rp was approximately 2 nm.

Comparison Example 2

A glass substrate made of aluminosilicate glass and having a diameter of 2.5 inches was prepared. The glass substrate was subjected to the rough polishing process, the precision polishing process, and the super precision polishing process as in the comparison example 1. The glass substrate, which was a test sample of the comparison example 2, was obtained in this manner. In the super precision polishing process, a polishing agent that was formed by dispersing particles of the same colloidal silica ($D_{50}$=20 nm) as that in the example 2 in sulfuric acid solution was used. The pH of the polishing agent was set to 3. The weighting of the soft polisher applied to the glass substrate and the polishing time were the same as those in the example 1. The abrasion amount was 0.2 μm. As in the example 1, the surface of the glass substrate of the comparison example 2 was observed with an AFM. The minimum roughness average Ra in the fields of view was 0.2 nm, and the maximum roughness average Ra was 0.25 nm. The minimum Rp was 1 nm, and the maximum Rp was 5 nm.

The results of the examples 1 and 2 show that using alkaline polishing agent after using an acid polishing agent produces a high quality glass substrate having Ra equal to or less than 0.4 nm and Rp equal to or less than 2 nm.

Referring to the results of the comparison example 1, after the super precision polishing process with only the polishing agent that used colloidal silica having particles of average size of 40 nm, Rp in each field of view was 2 nm, and no large projections were formed. However, compared to the example 1, in which Rp was approximately 1.5 nm, and to the example 2, in which Rp was approximately 1 nm, Rp of the comparison example 1 was obviously greater. Ra in each field of view was approximately 0.42 nm. Compared to the example 1, in which Ra was approximately 0.36 nm, and to the example 2, in which Ra was approximately 0.23 nm, the surface of the glass substrate of the comparison example 1 is rougher, and the quality is inferior.

Referring to the results of the comparison example 2, after the super precision polishing process with only the acid polishing agent that used particles of average size of 20 nm, which is less than that of the comparison example 1, Ra was from 0.2 to 0.25 nm. Ra is thus improved compared to Ra of the comparison example 1 and bears comparison with those in the example 1 and the example 2. However, Rp was 1 to 5 nm, and the difference between the minimum Rp and the maximum Rp was great in each field of view. That is, large projections are formed on the surface of the glass substrate. Also, since Rp of the glass substrate after the precision polishing process was 5 nm, using an acid polishing agent having particles of smaller size is not likely to remove the large projections.

That is, referring to the results of the comparison examples 1 and 2, if the polishing process is performed using only an acid polishing agent, Ra is likely to exceed 0.4 nm and Rp is likely to exceed 2 nm. Accordingly, the surface of the glass surface will be rough and large projections will remain. In other words, the quality is highly likely to deteriorate. The results of the examples 1 and 2 show that using alkaline polishing agent after using an acid polishing agent eliminates defects such as roughness and large projections from the surface. Accordingly, a high quality glass substrate is obtained.

It should be apparent to those skilled in the art that the present invention may be embodied in many other specific forms without departing from the spirit or scope of the invention. Particularly, it should be understood that the invention may be embodied in the following forms.

If Ra of the surface of the glass substrate is formed to have an Ra from 0.3 to 1.0 nm and an Rp from 3 to 7 nm in the polishing process of the first stage, a super precision polishing process may be applied in the polishing process of the second stage, and the polishing may be finished in two stages. Alternatively, the polishing may be performed in four or more stages.

For example, the glass substrate may be chemically strengthened before being polished. Alternatively, a chemical strengthening process may be performed between the first stage polishing process and the second stage polishing process. In this case, the super precision polishing process is easily performed compared to the illustrated embodiment. Further, the surface of the glass substrate is prevented from being roughened by a chemical strengthening after polishing. Accordingly, the production efficiency is improved, and the quality of the glass substrate is improved.

The glass substrate may be manufactured without the chemical strengthening process if the glass substrate satisfies requirements as a data recording medium such as the impact resistance, the vibration resistance, and the heat resistance. If the chemical strengthening process is omitted, defects such as chippings and cracks created in cutting, grinding, and polishing of the glass substrate are preferably filled by melting or eliminated by shaving, thereby maintaining the strength of the glass substrate.

The glass substrate may be washed with the cleaning liquid of the illustrated embodiment in each interval between the stages. In this case, the quality of the manufactured glass substrate is further improved.

Therefore, the present examples and embodiments are to be considered as illustrative and not restrictive and the invention is not to be limited to the details given herein, but may be modified within the scope and equivalence of the appended claims.

The invention claimed is:

1. A method for polishing a surface of a glass substrate for a data recording medium, the method including a rough polishing step, a precision polishing step, and a super precision polishing step, the super precision polishing step comprising:

a first polishing step for polishing the surface of the glass substrate with a first suspension, wherein the first suspension contains particles and a dispersion medium in which the particles are dispersed, wherein the main ingredient of the particles is silicon dioxide ($SiO_2$), and the average size ($D_{50}$) of the particles is equal to or less than 100 nm, and wherein the dispersion medium comprises an acid solution the pH of which is equal to or less than 4; and a second polishing step for continuously polishing the surface of the glass substrate with a second suspension, wherein the second suspension contains particles and a dispersion medium in which the particles are dispersed, wherein the main ingredient of the particles is silicon dioxide ($SiO_2$), and the average size (D50) of the particles is equal to or less than 100 nm, and wherein the dispersion medium comprises an alkaline solution the pH of which is equal to or more than 8.5.

2. The method according to claim 1, wherein the abrasion amount of the glass substrate in the first polishing step is equal to or more than 0.1 $\mu$m, and wherein the abrasion amount of the glass substrate in the second polishing step is from 0.01 to 0.03 $\mu$m.

3. The method according to claim 1, wherein the abrasion rate, which represents an abrasions amount per unit time, is from 30 to 600 nm/min in the first polishing step, and wherein the abrasion rate is form 10 to 500 nm/min in the second polishing step.

4. The method according to claim 1, wherein the concentration of the acid solution in the first suspension is from 2 to 95% by weight.

5. The method according to claim 1, wherein the concentration of the particles in each of the first and second suspension is from 5 to 40% by weight.

6. The method according to claim 1, wherein the roughness average (Ra) of the surface of the glass substrate supplied to the first polishing step is from 0.3 to 1.0 nm, and wherein the maximum profile peak height (Rp) of the surface of the glass substrate is from 3 to 7 nm.

7. The method according to claim 1, wherein, after being polished in the first and second polishing steps, the roughness average (Ra) of the surface of the glass substrate is equal to or less than 0.4 nm, and wherein the maximum profile peak height (Rp) of the surface of the glass substrate is equal to or less than 2 nm.

8. The method according to claim 1, wherein the rough polishing step is performed prior to the first polishing step, wherein, in the rough polishing step, a polishing agent containing particles and water in which the particles are dispersed is used, and wherein the average size of the particles is approximately 1.2 $\mu$m.

9. The method according to claim 8, wherein the precision polishing step is performed between the rough polishing step and the first polishing step, wherein, in the precision polishing step, a polishing agent containing particles and water in which the particles are dispersed is approximately 0.8 $\mu$m.

10. The method according to claim 1, further comprising a chemical strengthening process is performed prior to the rough polishing step.

11. The method according to claim 1, further comprising a chemical strengthening process is performed between the rough polishing step and the precision polishing step.

12. The method according to claim 1, further comprising a chemical strengthening process is performed between the precision polishing step and the super precision polishing step.

* * * * *

UNITED STATES PATENT AND TRADEMARK OFFICE

CERTIFICATE OF CORRECTION

PATENT NO. : 7,010,939 B2
APPLICATION NO. : 10/613694
DATED : March 14, 2006
INVENTOR(S) : Yoshikawa et al.

It is certified that error appears in the above-identified patent and that said Letters Patent is hereby corrected as shown below:

Column 14,
Line 6, delete "(D50)" and insert -- ($D_{50}$) --;
Line 19, delete "form" and insert -- from --.

Signed and Sealed this

Twentieth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 7,010,939 B2
APPLICATION NO. : 10/454230
DATED : March 14, 2006
INVENTOR(S) : Yoshikawa et al.

It is certified that error appears in the above-identified patent and that said Letters Patent is hereby corrected as shown below:

Column 14,
Line 6, delete "(D50)" and insert -- ($D_{50}$) --;
Line 19, delete "form" and insert -- from --.

This certificate supersedes certificate of correction issued June 20, 2006.

Signed and Sealed this

Fifth Day of September, 2006

JON W. DUDAS
*Director of the United States Patent and Trademark Office*